United States Patent [19]

Allsopp et al.

[11] Patent Number: 4,864,953

[45] Date of Patent: Sep. 12, 1989

[54] BATTEN FOR SAIL

[75] Inventors: James F. Allsopp, Annapolis; Robert Schwartz, Stevensville, both of Md.

[73] Assignee: North Sails, Inc., Annapolis, Md.

[21] Appl. No.: 165,767

[22] Filed: Mar. 9, 1988

[51] Int. Cl.[4] ..... B63H 9/04

[52] U.S. Cl. ..... 114/103

[58] Field of Search ..... 114/39.1, 39.2, 102, 114/103, 107

[56] References Cited

U.S. PATENT DOCUMENTS

| | | | |
|---|---|---|---|
| D. 255,892 | 7/1980 | Fehlberg | 114/102 |
| 2,378,877 | 6/1945 | Waller | 114/103 |
| 2,608,172 | 8/1952 | Biuw | 114/103 |
| 3,581,698 | 6/1971 | Bete | 114/102 |
| 3,905,321 | 9/1975 | Blythe | 114/103 |
| 4,136,630 | 1/1979 | Fraser | 114/102 |
| 4,461,231 | 7/1984 | Hoyt | 114/102 |
| 4,633,798 | 1/1987 | Skinner et al. | 114/103 |

*Primary Examiner*—Sherman D. Basinger
*Assistant Examiner*—Stephen P. Avila
*Attorney, Agent, or Firm*—Juettner, Pyle, Lloyd & Verbeck

[57] ABSTRACT

A partial or full length sail batten includes a pair of elongated flexible members disposed on opposite sides of the sail together with fasteners to secure the members together through the body of the sail.

13 Claims, 4 Drawing Sheets

BATTEN FOR SAIL

This invention relates sails for boats and other vehicles and more particularly to a batten for supporting portions of a sail.

Battens are elongated flexible members which are used to support and maintain the shape of sails made of cloth or other materials. Such battens are incorporated at spaced intervals in the sail and are used primarily to stiffen the relatively unsupported areas of the sail, such as a trailing portion or roach. In recent times, full length battens have been emloyed, which extend completely across the width of the body of the sail.

In accordance with conventional procedures, during manufacture of a sail, elongated pockets made from strips of cloth are sewn to the body of the sail. The battens, made from flat strips of wood or composites, are inserted into an open end of the pocket. The fabrication of batten pockets in a sail is very labor intensive. Also, the pockets are subject to wear and require maintenance.

A variety of methods for making conventional sail battens have been proposed. Recent examples are shown in U.S. Pat. Nos. 4,136,630 No. 3,905,321, No. 3,581,698 and No. 4,633,798.

SUMMARY OF THE INVENTION

The present invention provides a sail batten which does not require the fabrication of pockets in the sail in order to hold or retaint he battens. In the present invention, each batten comprises a pair of opposed elongated members which are disposed on opposite surfaces of the sail and which are secured together through the sail fabric to provide a unitary structure with each other and with the body of the sail. The members may be secured together with suitable fasteners through small openings in the body of the sail.

The present invention allows for the easy selection of a variety of lengths, sizes and flexibility of battens for a particular sail, as well as a choice of locations for placement of the battens.

THE DRAWINGS

DESCRIPTION OF THE PREFERRED EMBODIMENTS

Figure 1:
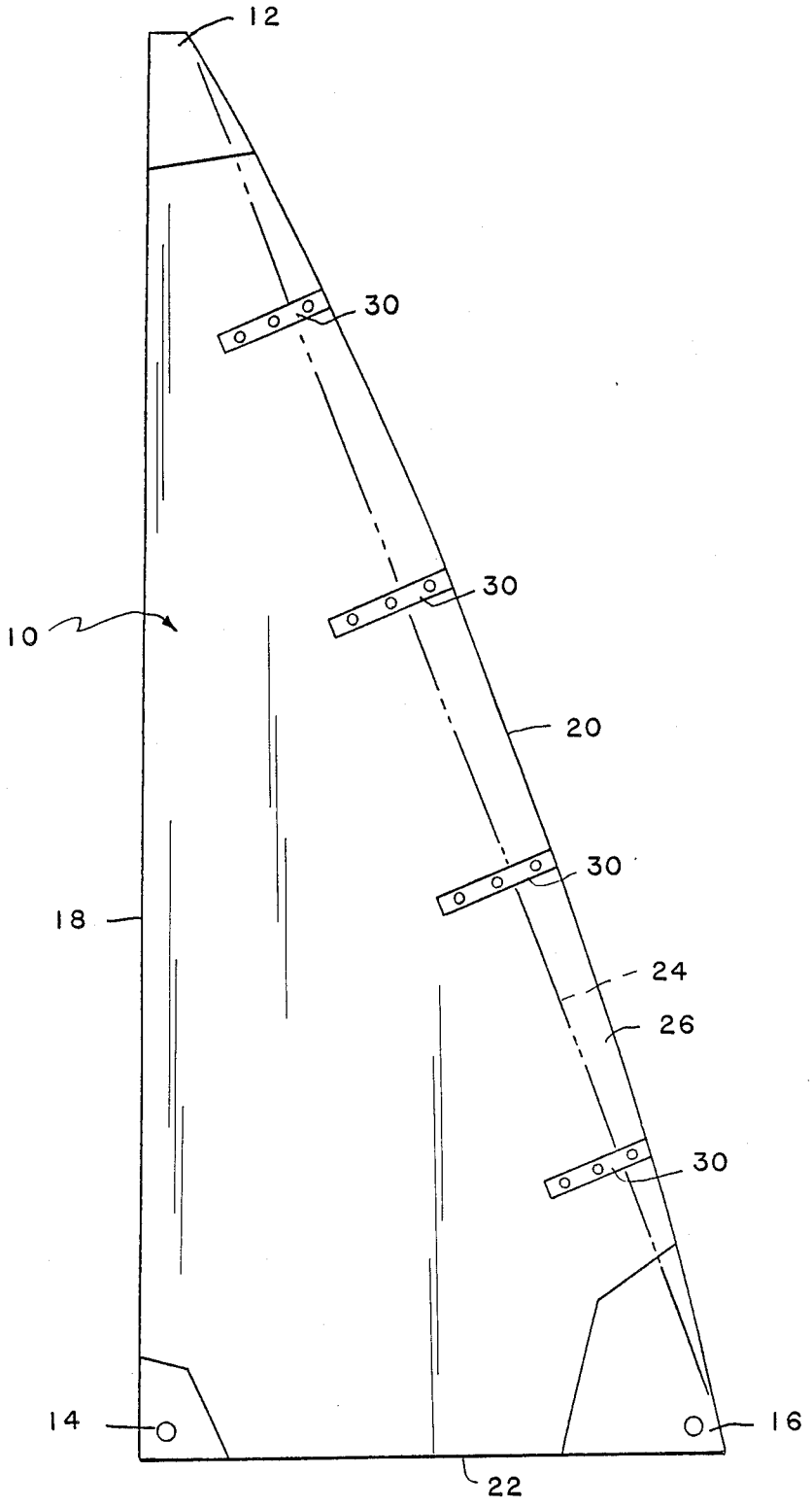
FIG. 1 is a plan view of a triangular sail having partial length battens of the present invention.
Figure 2:
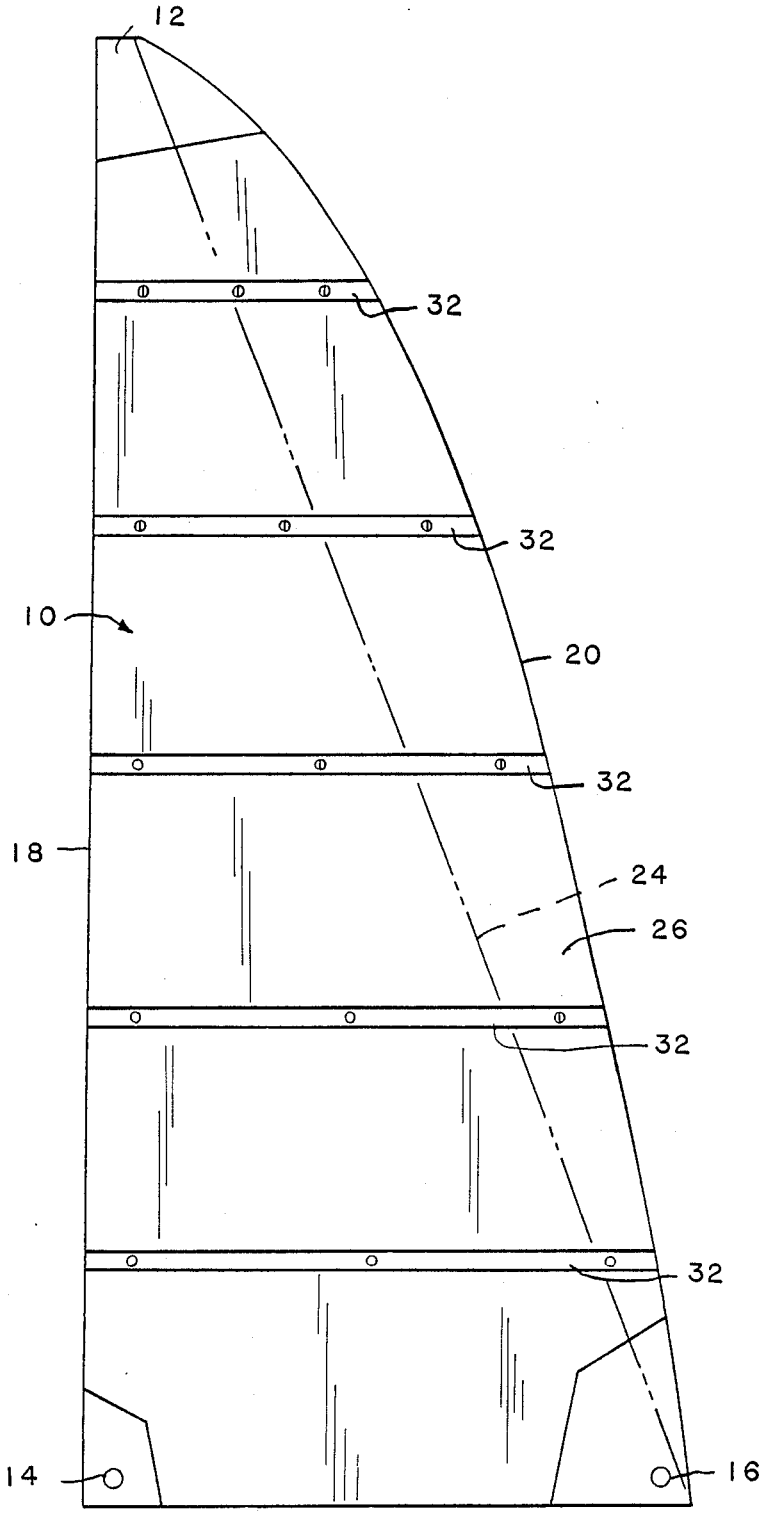
FIG. 2 is a plan view of another triangular sail having full battens of the present invention.

FIGS. 1 and 2 illustrate triangular sails of conventional design. The term "sail" as used herein means a pliant body which is supported in a fashion to enable it to be driven by the wind. Triangular shapes are used in most mainsails and genoas, although other shapes may be employed. The sail is made from a pliant fabric such as woven cloth, film, and combinations thereof. The sail is usually fabricated from a plurality of panels which are seamed together, and reinforcing panels are applied at the corners, as shown.

The sail 10 shown in FIG. 1 and 2 has three corners referred to as the head 12, tack 14 and clew 16. The leading portion or edge of the sail is referred to as the luff 18, the trailing edge is the leech 20, and the bottom edge is the foot 22. In many cases, the leech 20 is extended outwardly from a line 24 between the head 12 and tack 14, and this portion is called the roach 26.

As shown in FIG. 1, a plurality of partial battens 30 may be applied to the sail 10, said battens extending longitudinally inwardly from the leech 20 toward the luff 18 and terminating at a point intermediate the wide of the sail. The battens are installed at generally uniformly spaced locations, preferably in parallel with each other and to the foot 22, or at acute angles relative thereto. Especially in the case where the unsupported roach 26 is not very large in area, the partial length batten 30 will provide sufficient support.

As shown in FIG. 2, in the event that the roach 26 is relatively large in size, such as in the case of a typical mainsail, full length battens 32 may be employed. In such event, the battens 32 will extend from a point near the luff 18 to the leech 20, or along the entire width of the sail 10, and are spaced along vertical line.

Figure 3:
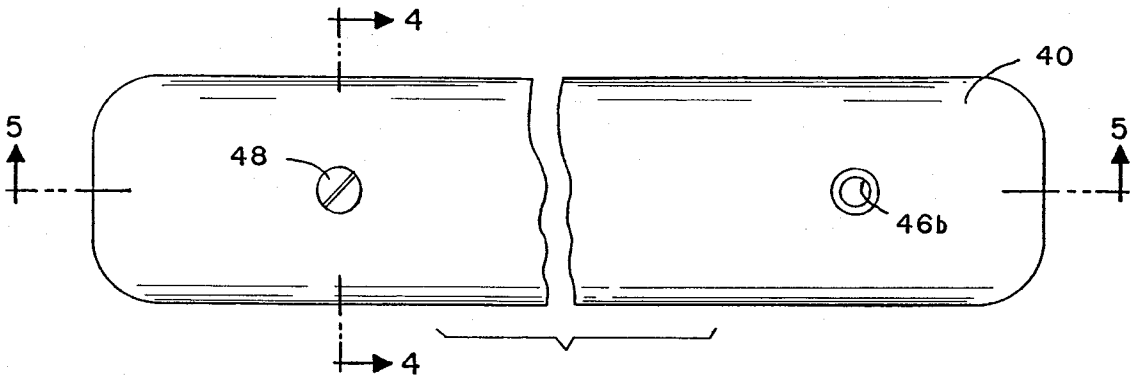
FIG. 3 is a plan view of one of the battens shown in FIGS. 1 and 2.
Figure 5:
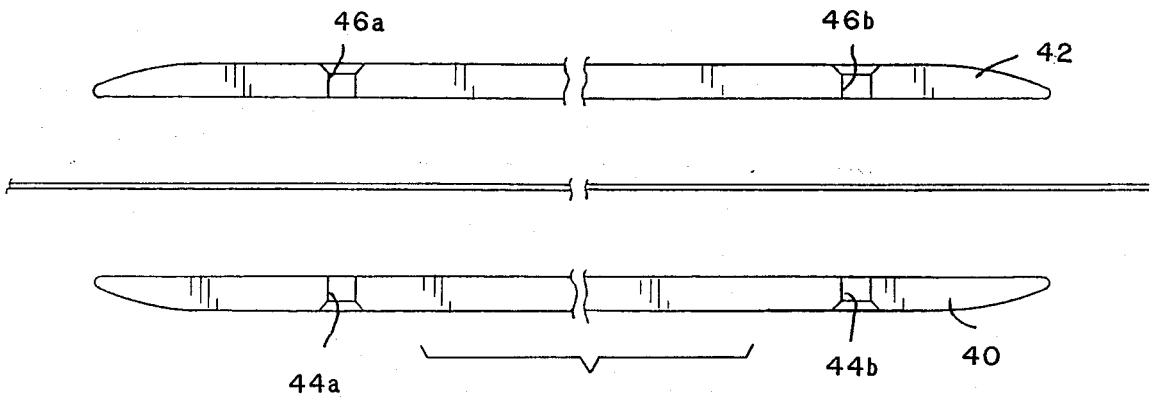
FIG. 5 is a sectional view taken along lines 5—5 of FIG. 3.
Figure 4:
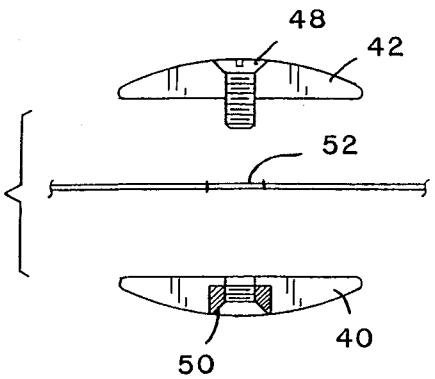
FIG. 4 is a sectional view taken along lines 4—4 of FIG. 3.

FIGS. 3, 4 and 5 illustrate the details of construction of the sail batten of the present invention. Rather than being carried in a separately fabricated pocket which is secured to the body of the sail, the battens are applied externally and are not surrounded by the fabric of a cloth pocket.

As shown, each complete batten comprises a pair of elongated thin and flat members 40 and 42 which are substantially coextensive in length. The members are disposed on opposite sides of the sail fabric 44 and are secured or clamped together through said fabric such that the two members act as a single member and also clamp the sail fabric therebetween. In the present embodiment, the members 40 and 42 are equi-sized, or substantially identical in length, width and thickness.

The facing surfaces of the members 40 and 42 preferably comprise flat portions to better clamp against and hold the planar sail fabric. Also, the ends of the members 40 and 42 are preferably rounded and smooth to prevent snagging or chafing of the sail fabric. The members are designed such that the exposed portions have an clean, aerodynamic shape and will offer minimal wind resistance. In this connection, the aspect ratio of the thickness to width of each member is in the order of about one to three to about one to four.

Due to the nature of their construction, the battens are somewhat more flexible toward a line perpendicular to the sail and must be sufficiently flexible to accommodate the curvature of the sail body under sailing conditions. In terms of full length battens as shown in FIG. 2, the permitted deflection should be in the order of about 10 to about 20 percent of the chord length.

A wide variety of known materials may be employed in the fabrication of the batten members. For example, the members may be molded from a polymer which is reinforced by fibers or fabrics to provide a smooth, nonabrasive outer surface which is dimensionally stable and resistant to deterioration by the elements.

Again with reference to FIGS. 3–5, means are provided for securing the members together in a clamping relation with the pliant sail fabric. A plurality of recessed openings may be provided through the respective members 40 and 42, such as 44*a*, 44*b* and 46*a*, 46*b*. The openings in the respective members are aligned to receive suitable fasteners. Any type of conventional fastener may be employed, such as the threaded bolt 48 and nut 50 shown in FIG. 4. A threaded connection enables adjustment of the clamping force, and a removable fastener allows the battens to be removed from the sail. In some cases, it may be desirable to remove the battens while making a repair to the sail or to exchange from one batten assembly to another having a different flexibility.

As shown in FIG. 4, openings 52 are provided through the sail fabric to accommodate the fasteners. If desired, these openings may be reinforced with grommets or the like.

Figure 6:
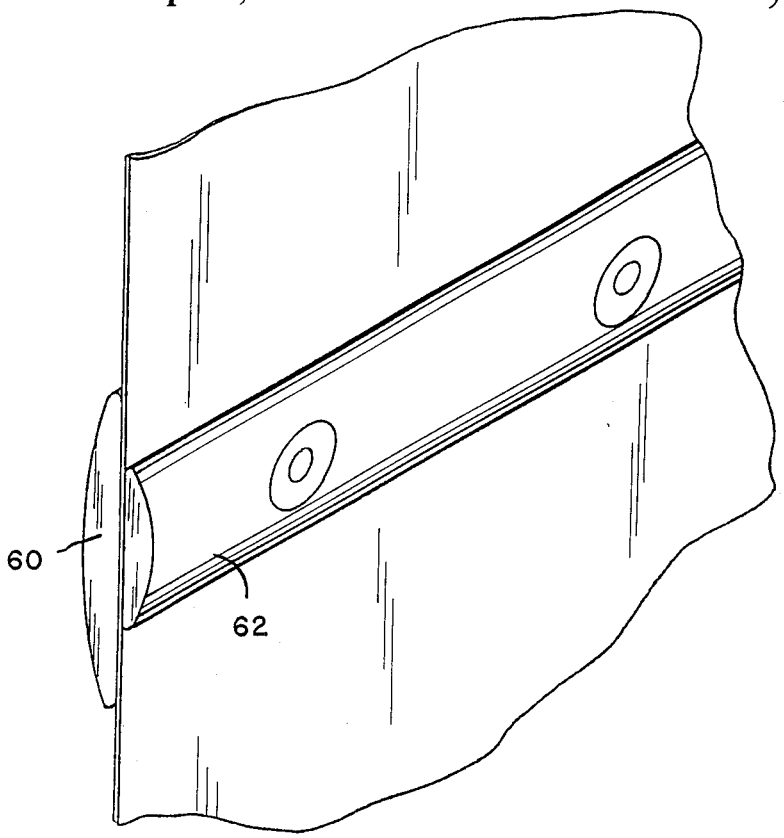
FIG. 6 is a isometric view of a sail with another embodiment of the batten of the present invention.

In many cases, it is desirable to provide battens having a variety of stiffnesses in a given sail, e.g., to have relatively stiff battens in the lower portion and more flexible battens in the upper portions. One method of accomplishing this would be to reduce the cross sectional size or area of both members. Another method is shown in FIG. 6, wherein the joined batten members 60 and 62 are unequal in stiffness. In the embodiment shown, the member 62 is thinner and/or less wide than the member 60. In this manner, the assembly would have a stiffness intermediate that of a pair of members 60 and the members 62 when used together.

Although not shown in the drawings, it is also possibile to vary the stiffness of an individual batten along its length. This may be accomplished by tapering the batten or by varying the spacing of the fasteners.

Figure 7:
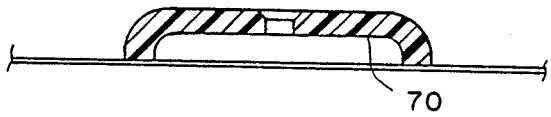
FIGS. 7 through 9 are transverse sectional views of one of the pair of batten members, illustrating additional shapes which may be employed.
Figure 8:
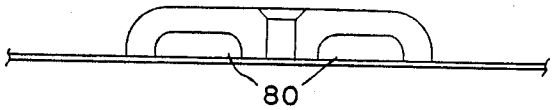
Figure 9:
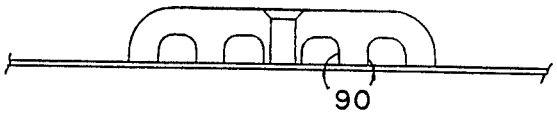

FIGS. 7 through 9 illustrate a variety of cross sectional shapes which may be employed. Rather than have a solid cross section as shown in FIGS. 4 and 5, one or a plurality of longitudinal cavities, such as 70, 80 and 90 may be provided in the facing portions of the members. This will enable, for example, reduction in weight aloft or establishment of any desired degree of flexibility.

We claim:

1. A batten system for a sail having a pliant body wherein the batten extends across the body in a supporting relationship, said batten system comprising a plurality of opposed pairs of separate elongated flexible members located on the respective sides of the pliant body, and means for connecting said opposed members together through said pliant body to provide a plurality of battens for said sail.

2. The batten of claim 1 wherein said members are coextensive in length.

3. The batten of claim 1 wherein said plurality of battens are disposed in a spaced and parallel relationship.

4. The batten of claim 1 wherein the means for connecting said members together through said sail body comprises an opening through said members and said sail body, and a fastener disposed through said openings.

5. The batten of claim 4 wherein a plurality of spaced aligned openings are provided in said members and the sail body, and plurality of fasteners through said openings.

6. The batten of claim 4 wherein said fastener is removable.

7. The batten of claim 1 wherein said members are of substantially the same size.

8. The batten of claim 1 wherein said members are of a different size.

9. The batten of claim 1 wherein the means for connecting said members together through said body are effective to clamp said members together in a unitary fashion with the sail body therebetween.

10. The batten of claim 1 wherein said sail has a leading edge and a trailing edge, and said batten extends on a line between said edges.

11. The batten of claim 10 wherein said batten extends from said training edge partially across the sail toward the leading edge.

12. The batten of claim 10 wherein said batten extends from said leading edge to said trailing edge.

13. The batten of claim 1 wherein at least one of said members has a longitudinal cavity therein.

* * * * *